US010662700B2

(12) United States Patent
Fedorov

(10) Patent No.: US 10,662,700 B2
(45) Date of Patent: May 26, 2020

(54) ENERGY EFFICIENT TRANSLUCENT STRUCTURE

(71) Applicant: OBSHHESTVO S OGRANICHENNOJ OTVETSTVENNOST'JU "TEPLORIUM", Cheboksary (RU)

(72) Inventor: Anatoly Nikolaevich Fedorov, Novocheboksarsk (RU)

(73) Assignee: OBSHHESTVO S OGRANICHENNOJ OTVETSTVENNOST'JU "TEPLORIUM", Cheboksary (RU)

( * ) Notice: Subject to any disclaimer, the term of this patent is extended or adjusted under 35 U.S.C. 154(b) by 0 days.

(21) Appl. No.: 16/088,839

(22) PCT Filed: Apr. 5, 2016

(86) PCT No.: PCT/RU2016/000190
§ 371 (c)(1),
(2) Date: Sep. 27, 2018

(87) PCT Pub. No.: WO2017/171578
PCT Pub. Date: Oct. 5, 2017

(65) Prior Publication Data

US 2019/0106932 A1 Apr. 11, 2019

(30) Foreign Application Priority Data

Mar. 30, 2016 (RU) ..... 2016111963

(51) Int. Cl.
*E06B 3/66* (2006.01)
*E06B 3/663* (2006.01)

(52) U.S. Cl.
CPC ..... *E06B 3/66309* (2013.01); *E06B 3/66323* (2013.01); *E06B 3/66347* (2013.01); *E06B 3/66366* (2013.01); *E06B 3/6612* (2013.01)

(58) Field of Classification Search
CPC ..... E06B 3/66309; E06B 3/6612
See application file for complete search history.

(56) References Cited

U.S. PATENT DOCUMENTS 2,834,999 A * 5/1958 Taylor ..... E06B 3/66328 52/172
4,081,934 A 4/1978 Helmut et al.
5,009,044 A * 4/1991 Baughman ..... E06B 3/6722 349/16

FOREIGN PATENT DOCUMENTS

RU 2267001 12/2005
RU 2448133 4/2012
(Continued)

*Primary Examiner* — Patrick J Maestri
(74) *Attorney, Agent, or Firm* — Dmitry S. Kryndushkin; IP Center Skolkovo

(57) ABSTRACT

Invention pertains to construction and installation methods for construction and renovation of production, public and residential buildings, in particular, to translucent barriers, therein windows, stained glass, glass facing, indoor winter gardens, atriums, clerestories, greenhouses, doors, indoor baffles and other structures both indoor and outdoor. Therein also may be integrated a solar panel, and electric heating elements, dehumidifier.

The engineering advantage of the invention is an improved heat insulation design, protection from both outdoor cold and excessive heat from the sun, an improved resistance to fluctuations of temperature, improved noise cancellation, absence of a condensate at the glass surfaces, increased glazing area without traditionally associated heat loss, absence of a freezing of reveals, improved reliability regarding breaking in, reduced integrity loss risk resulting from fire
(Continued)

(fire resistance), reduced convection and consequently increased isolation properties due to greater spacing between glass sheets, increased containment, simplicity of installation and replacement (repair) of IGU modules without disruption outer shell of the building (heating contour of the building) due to partial disassembly of the structure, increased resistance to potential impacts in transportation and installation. Translucent structure according to invention contains at least four glass sheets, joined together in at least two independent IGU modules (IGUs), each containing at least two parallel glass sheets distanced 10-1000 mm, the glass sheets in IGUs are glued together by a spacer frame and a sealant, and IGUs themselves are joined together by a thermo insulation reinforced frame, creating a sealed chamber in between IGUs.

3 Claims, 4 Drawing Sheets

(56) References Cited

FOREIGN PATENT DOCUMENTS

| | | | |
|---|---|---|---|
| RU | 2476659 | C2 | 2/2013 |
| RU | 2510704 | | 10/2013 |
| RU | 146034 | U1 | 9/2014 |
| SU | 1399441 | A1 | 5/1988 |

* cited by examiner

ENERGY EFFICIENT TRANSLUCENT STRUCTURE

TECHNICAL FIELD

The invention pertains to construction and types of installation in construction and renovation of production facilities, as well as public and residential buildings. It belongs to translucent protective structures, such as windows, stained glass, glass facing, indoor winter gardens, atriums, clerestories, greenhouses, doors, baffles and other structures both indoor and outdoor. Therein also may be integrated a solar panel, and electric heating elements.

BACKGROUND

There is a well known translucent structure comprising two or more single glass sheets where all the sheets are interconnected around the edge by a spacing frame (a separator between the glass sheets), filled with a moisture collection agent, and glued together by a polymer substance—sealant—for improved fixation of structural elements and ensuring air containment.

Structures containing two glass sheets, sealed together by a sealant with spacing frame are usually called a single chamber insulated glass unit, if two or more glass sheets are used, then it is called a dual-chamber, three-chamber, and multi-chamber glass unit respectively.

Compared to a single glass sheet, IGUs (Insulated Glass Units, or Insulated Glass Unit modules) possess improved heat and sound isolation properties. Against the single glass, heat transfer through the singe chamber unit is reduced due to air spacing between the glass sheets. But there is a limit in a distance between the glass sheets beyond which air circulation in-between the glass sheets may result in increased energy transfer.

Energy efficiency may be increased by adding glass sheets and, accordingly, adding layers of air insulation, and sealing around the edges (multi-chamber IGUs).

Also for the reduced heat transfer the air spacing between the glass sheets may be filled with a denser gas with lower heat transfer coefficient (argon, krypton, xenon, sulfur hexafluoride).

Chamber thickness (spacing), created by the width of the spacer frame, determines heat transfer resistance coefficient of the window (R, $m^{2o}$ C./Watt, rus). It reduces with growing chamber thickness to a certain degree and then it grows back up again. For each filler (air, or noble gas) there is an optimal spacing width at which the window heat transfer is minimal. With increased chamber thickness beyond optimal value, air or gas circulation occurs inside the chamber which results in increased heat transfer. Thus the optimal spacing varies between 6 and 16 mm, the max spacing between the glass sheets is not more than 16 mm, further spacing increase results in loss of energy efficiency of the IGU.

In mass produced IGUs the required spacing between the glass sheets is ensured by rigid spacer frames usually of hollow aluminum profile, steel, plastic with metal film or a stripe of thermoplastic based on polyisobutylene or butyl rubber as sealants and glues. Usually the spacing frame wall facing inside has small orifices and the frame cavity contains a drying agent, absorbing moisture and any other solvent. This prevents buildup of condensate in between the lies at low ambient temperatures. A groove created by a spacing frame facing out in between the glass edges is usually filled with two component glue-sealant, which builds a rather solid, fixed connection between the glass sheets and the spacing frame of the unit.

There is a known glued IGU, including a minimum of two glass sheets and at least one spacing frame, placed between the glass sheets with a creation of a sealed space, the spacing frame has at least two orifices in opposing sides opening the enclosed space to the outer ambience. One of the orifices has a standard filter (RU 2171883, dated 10 Aug. 2001)

There is another known IGU (RU 2448133, dated 20 Apr. 2012), with sealant hardening at room temperature with low gas permeability and containing at least two spaced sheets of glass. Low heat transfer gas between them including the hardening sealant comprising the following:

a) polydiorganosiloxane, showing gas permeability;
b) At least one polymer, permeable to the specified gas, which is lower than the permeability of polydiorganosiloxane;
c) Polymerizing agent and
d) catalyst for polymerization There is a known window unit with isolation glass and its fabrication method (RU 2432329, dated 27 Oct. 2011), containing the first glass substrate, bearing a multi layer coating for solar energy control; the second substrate, separated from the first glass substrate one of each bearing a multilayer coating for solar energy control and a protective UV coating with more than one layer, altogether the UV coating is on top of solar energy filtering layer at the same substrate. Solar energy control coating includes one infrared protective layer containing silver, not less than one dielectric layer in-between the infrared coat and substrate and at least one dielectric layer on top of the infrared coat.

From RU 2267001, dated 27 Dec. 2005 there is a known IGU, its production method and profile applied as spacer for the isolating glass chamber, at least two glass sheets are separated by gas medium, with spacer separating two glass sheets, one side of which is facing internal gas, and the opposite external side, as well as sealants ensuring containment of the internal medium. Where the spacer is essentially a flat profile going around the edges of the glass, its internal side goes on top of the edges and then the connection is sealed.

The abovementioned inventions are short of energy efficiency and sound isolation properties, when compared to the proposed invention, due to limitations of spacing between the glass sheets of the module, inseparability due to filling of spacing between the glass sheets with a sealant, making it impossible to replace it in service time for example in case of window breakage. No opportunity for all-year-around anytime replacement of the damaged IGU. Poor containment against the proposed invention, low shock endurance in transportation and installation. Five chamber IGUs comprising 6 glass sheets also have the drawbacks: great weight, cost, difficulty of manufacturing and installation, limitations for applications in high multistory buildings.

The best analogue to the proposed invention is a translucent construction with heating (RU 2510704, dated 10 Apr. 2014), containing a number of parallel glass sheets where certain glass sheets have a conductive coating at the internal surface of one of the exterior glass sheets. Altogether, the glass sheets are installed with spacers and insulating adhesive gaskets and form a sealed gas chamber. The internal surface of the other external substrate as well as each internal substrate surface is treated with low emission coat, with conductive layer at opposing edges of the outer glass sheet by deposition coating. Conductive threads are deposited in two stages from aluminum-zinc and copperzinc alloy in the areas of insulating and adhesive gaskets. Those conductive threads are wired and connected to power source.

The drawback of the closest analogue is manufacturing sophistication, difficult installation, power dependence requiring electricity; it loses its efficiency in power failures, and entails increased power consumption, high material demand in terms of fabrication of electrical equipment (thermostat), short service life 10 years, no protection from excessive sun radiation (heat), frequent failures, high product cost.

DESCRIPTION OF INVENTION

The proposed invention is purposed at fabrication of translucent structures with improved energy efficiency, reduced solar heating effects, reduced heat loss in wintertime, smoothened drastic temperature fluctuations, reduced convection, improved noise isolation. The purpose also is to exclude condensate buildup, create a possibility of partial local replacement of glazing without disruption outer shell of the building (heating contour of the building). It is targeted at savings through use of less powerful heaters and AC systems in construction of buildings.

The engineering outcome of this invention will be improved heat insulation properties of buildings. Greater protection from the cold and against excessive sun heat, improved resistance to temperature fluctuations, improved noise cancellation, no condensate on windows, possibility of increase of glazing surface area without associated heat loss, no freezing of reveals, increased resistance to breakage, risk mitigation of integrity loss and collapse in fire (improved fire resistance), reduced convection and resulting possibility of higher isolation properties due to increased spacing between internal glass sheets, improved containment, ease of installation and partial repair (replacement) of glazing unit without disruption of outer shell of the building due to possibility of partial disassembly of the unit, higher resistance to edge breakage during transportation and installation.

This technical performance is achieved due to use of at least 4 glass sheets joined into the least of 2 independent glass units each containing at least 2 substrates in parallel spaced from each other 10-1000 mm. altogether the sheets in glass units are glued together by the spacer and sealant, and unit's glass modules are interconnected by a frame of reinforced profile creating a sealed chamber in between the modules. In preferred embodiments the inter-modular insulation chamber is filled with air, noble gas, CO2 or is partially vacuumed.

Argon, xenon, krypton, sulfur hexafluoride may be used as noble gas.

Inter-modular chamber may be 10-1000 mm thick.

A space between two parallel glass sheets inside at least one said IGU module may be filled with air, noble gas or $CO_2$.

BRIEF DESCRIPTION OF DRAWINGS

The invention is more understood after the description without restrictions and illustrated by referenced drawings showing.

Figure 1:
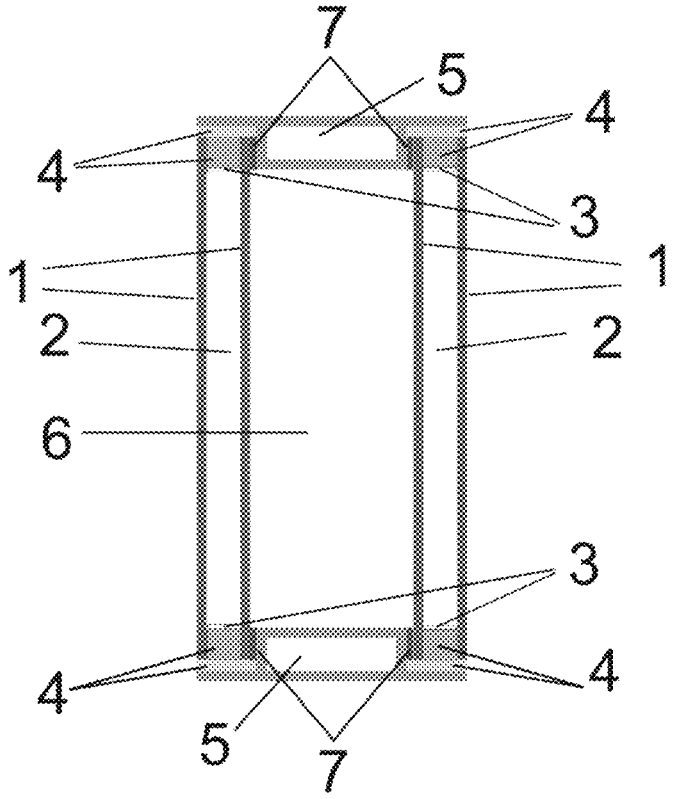
FIG. 1—Transverse section of a translucent structure of 4 glass sheets (two single chamber IGUs)
Figure 2:
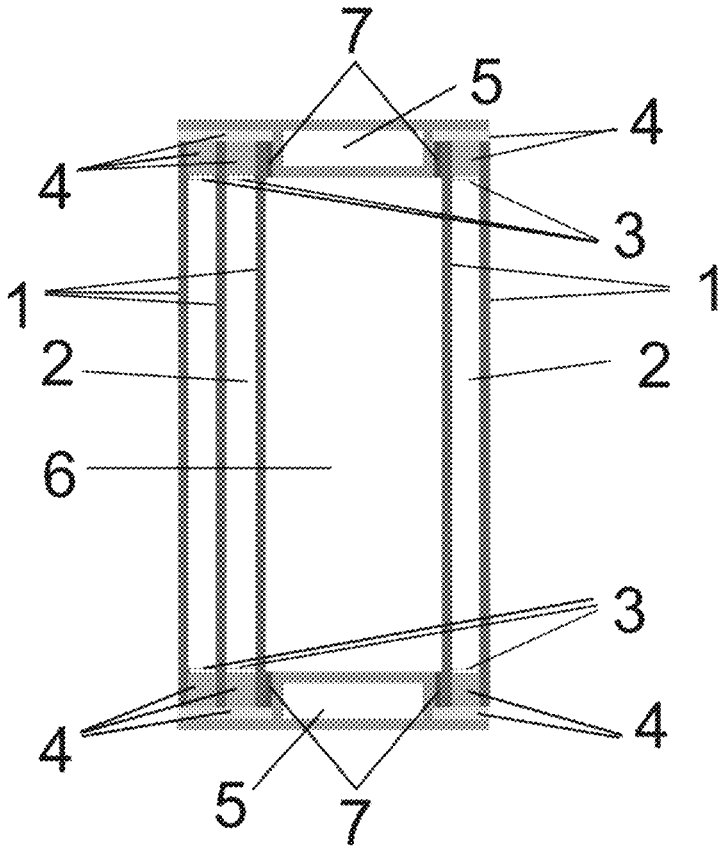
FIG. 2—Transverse section of a translucent structure of 5 glass sheets (one is single chamber and another one is a dual-chamber IGU)
Figure 3:
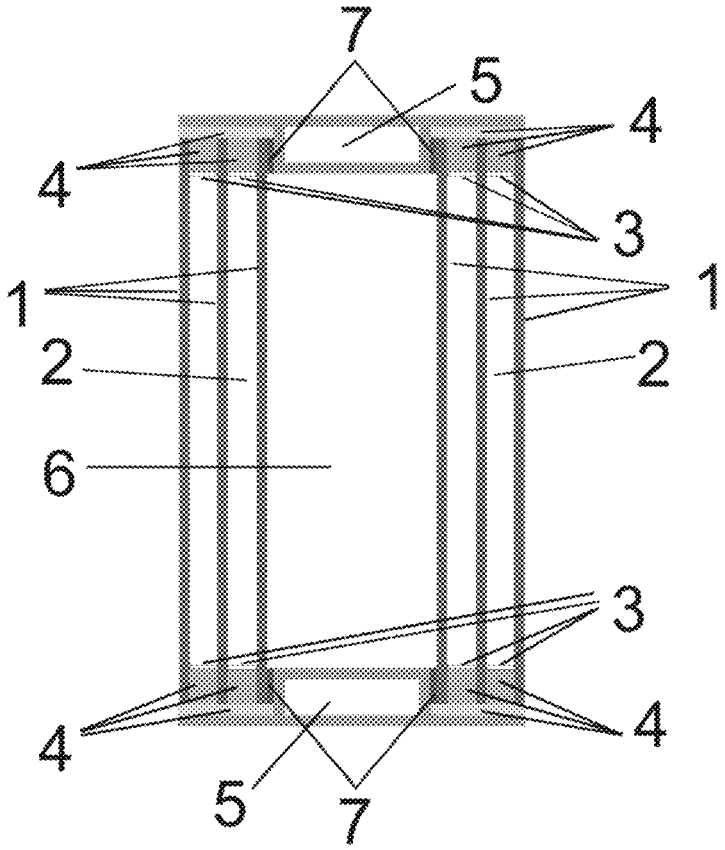
FIG. 3—Transverse section of a translucent structure of 6 glass sheets (two dual-chamber IGUs)
Figure 4:
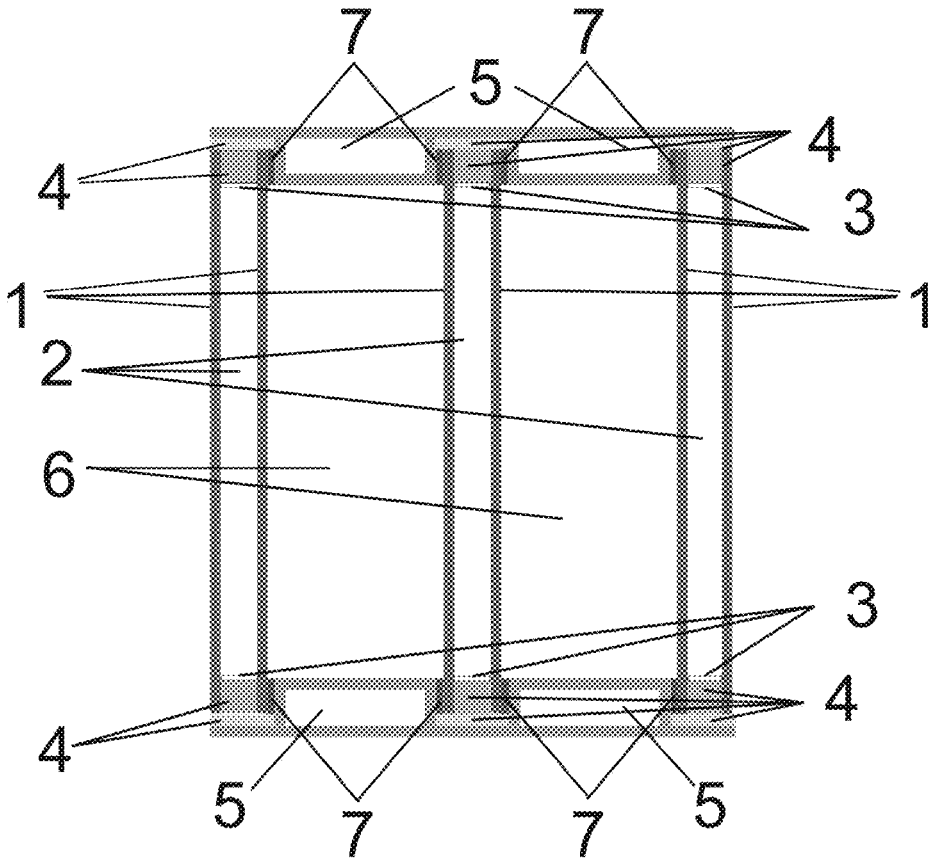
FIG. 4—Transverse section of a translucent structure with two sealed chambers.

For all of the figures: 1—a glass sheet; 2—a IGU; 3—a spacer frame; 4—a sealant; 5—a frame of a thermo isolation reinforced profile; 6—a sealed chamber; 7—a gasket.

IMPLEMENTATION

Translucent structure, containing at least four glass sheets (1), joined together in at least two independent IGU modules (2), each containing at least two parallel glass sheets (1) distanced 10-1000 mm, altogether the glass sheets (1) in IGUs (2) are glued together by a spacer frame (3) and a sealant (4), and IGUs (2) themselves are joined together by a frame of thermo insulation reinforced profile (5), creating in between the IGUs a sealed chamber (6).

Sealed chamber (6) may be filled with air, noble gas, carbon dioxide or a partial vacuum.

Argon, Xenon, Krypton, Sulfur Hexafluoride may be used as a noble gas.

Sealed chamber (6) may be 10-1000 mm thick.

The space between the two parallel glass sheets inside IGU (2) may be filled with air, noble gas, carbon dioxide.

The thermo insulation reinforced profile (5) is made of polyamide, aluminum or a composite material, selected from the following groups: fiberglass, carbon fiber and other.

The thermo insulation reinforced profile (5) is either not hollow, hollow, or semi hollow with internal chambers.

Glass sheets (1) are regular, mass specific, laminated, treated with deposition (armored, triplex, tempered, solar protective, self cleaning, energy saving, stained/dim and other).

Glass sheets (1) may be any conventional thickness (1.2-50 mm).

IGUs (2) may have one or more chambers with optimal spacing between the glass sheets. More widely used are dual chamber IGUs.

The sealed chamber may have blinders, various purpose shades, various devices (solar panel, thermometer), and dehumidifier.

The sealed chamber (6), predominantly at the sides, may have electric heating elements.

The translucent structure may be fabricated in the following way. Glass sheets (1) with the help of a spacer frame (3) and a sealant (4) are glued together into IGUs (2). Then it is assembled into a frame of a thermo insulation reinforced profile (5), whereas connection of its elements is conducted at corners by inserting dehumidifiers into the frame of thermo insulation reinforced profile (5) gluing together or heat welding. Between the IGU (2) and the frame of the thermo insulation profile (5) a gasket (7) is introduced. IGUs (2) are inserted into the reinforced thermo insulation frame (5). The space between the edge of IGU (2) and the protrusion of the frame of the thermo insulation profile (5) is sealed (4).

In the other option of fabrication of the translucent structure, namely in staged assembly at the location of installation, there is no reveal; the translucent structure is attached to the bearing frame, serving as thermo insulation reinforced frame.

Similarly they fabricate a design consisting of three IGUs, each comprising two glass sheets at least. In this case in between three IGUs (2) joined together by two reinforced insulating frames (5) creating two sealed chambers (6) between them. Heat insulation of such a translucent structure exceeds heat insulation of non transparent walls (Russian Construction Standards SNiP 23-02-2003), enabling construction of full glass walls avoiding heat loss. This is very urgent for both business and public buildings, since it allows making best use of daylight.

The design is used as a wall (immovable, non-opening) glasswork and opening (windows and doors) glazing, which may be introduced into a solid glass facing.

The main installation methods for walled mostly glass facing is using modular translucent design, installing it into the hole without additional profile or by means of integration into bearing structure. Altogether the bearing structure may be of aluminum, steel, alloys, wood, composites (fiberglass, carbon fiber) and other materials and their combinations, used as supporting structures including various glazing facing systems.

The main installation method for the opening glass structure (window and door) is installation of the clear structure into a door-frame, fixed inside the opening of the window or the doorway posts.

Altogether, the profile material for the sash frame is not limited in selection. It may as well be of aluminum, wood, plastic, composite materials (fiberglass, carbon fiber) and other materials and their combinations, used for fabrication of sashes and doors.

Opening translucent structure has various ways of opening sashes: with turn, tilt, tilt-and-turn, slide opening mechanisms.

If aluminum is used for profile, then several layers of thermo barriers are used, of polyamide and other insulation material, in between the aluminum profile chambers, such thermo barriers may be from 1 to 4 pcs in a profile.

Moreover there is an option of consecutive assembly and installation, of at least two independent IGUs each of which is installed into a separate profile. They are connected by compression and gluing with creation of a sealed chamber between them. The spacing between the IGU modules makes 10-1000 mm. In this case thermo insulation frame is represented by a bound bearing profile framework. This method of assembly and installation is best for mostly external glazing, when there are large glazing areas and for multiple story buildings (various glass facing systems)

In addition, translucent structures of the proposed design are applicable for modernization, insulation of the existing glazing and such, representing a single glass sheet or a single IGU. Additional IGUs are installed to the existing structure of an installed IGU, consisting of at least two glass sheets creating space of 10-1000 mm between the existing glass sheets and additional IGU. Altogether, there is no need in disassembly or removal of the old glazing. In other words, modernization and insulation is conducted without breaking the heating contour of the building. This is different from a traditional way of modernization by complete replacement with more efficient ones.

The table below lists physical properties of the proposed translucent structure.

TABLE

| Physical Properties | Conventional IGUs | Proposed new Design |
|---|---|---|
| Heat transfer resistance factor, R, $m^2 \cdot {}^\circ C./W$ | 0.32-1.56 | over 1.56 |
| Heat Transfer Coefficient, U, $W/m^2$ ° C. | 0.64-3.1 | under 0.64 |
| Noise Cancellation, dB | 20-38 | over 40 |

Thus, the proposed invention offers a translucent structure, possessing improved heat insulation performance, ensuring better protection from cold and from excessive solar radiation, creating a solar collector effect in a sealed chamber as in a winter greenhouse, reduced convection and a possibility of increased insulation properties due to expanded width of a sealed chamber. Also, it offers an improved durability at the edges, durability in transportation and installation, due to a frame of thermo insulation reinforced profile, modular design that ensures possibility of local repairs without breaking heating contour of the building up to an IGU comprising at least two sheets of glass, differently from conventional non modular translucent structures in one glass sheet or any other IGUs. It also offers an improved containment, and noise cancellation, void of condensate at glass sheets, greater glazing area without heat loss. It also offers a simplified installation without a window frame right into the wall opening, no freezing of ledges, improved resistance to damage and fire.

All of this ultimately implies energy saving, reduced operating costs on heating and air conditioning, reduced capital expenditures due to lower limit on grid connection rates to centralized heating system and installation of a less powerful heating units, eliminating AC system, resulting in a higher level of fire resistance of the design, mitigation of risks of loss of integrity, collapse of the structure resulting from fire, simplified inspection allowing visual (without instruments) analysis of containment, excluding the least misting in between the glass sheets, in possibility of fabrication of turning sashes, bigger size doors, less cost on facility lighting, no need of cleaning of internal space in during service life, reduced use of electric heating of transparent roofs, greenhouses, domes, atriums, clerestories and similar designs, possibility of construction of fully translucent buildings without heat loss, improved comfort of dwelling, in unlimited possibilities for architectural design.

The invention was disclosed here with a reference to a specific implementation. For specialists there may be some other obvious variants of embodiments of the invention that do not change its essence, as it is present in the current description. Accordingly, the invention should be considered limited in volume only by the following claims.

The invention claimed is:

1. A dismountable transparent solar collector, comprising at least two independent IGU modules, wherein each said IGU module contains at least two parallel glass sheets glued together by a spacer frame and a sealant; and said IGU modules are integrated by a thermo insulation reinforced profile having a T-shaped form in the cross-sectional view with two narrow protrusions and a wide central part, wherein said reinforced profile and the IGU modules create a sealed chamber with a width of 10-1000 mm between two neighboring IGU modules; wherein said profile in the narrow protrusions is attached to the end surfaces of said neighboring IGU modules by means of the sealant, and wherein said profile in the wide central part from each side is attached to the glass sheets of said neighboring IGU modules by means of a gasket, in such a way to create possibility for replacement of one of the IGU modules and for restoration of the functional solar collector after such replacement.

2. The structure according to claim 1, wherein the sealed chamber is filled with air, noble gas, $CO_2$ or with a partial vacuum.

3. The structure according to claim 1, wherein a space between two parallel glass sheets inside at least one said IGU module is filled with air, noble gas or $CO_2$.

* * * * *